United States Patent [19]

Bates et al.

[11] Patent Number: 4,789,141

[45] Date of Patent: Dec. 6, 1988

[54] NOZZLES FOR INJECTING SUBSTANCES INTO LIQUIDS

[75] Inventors: Kenneth W. Bates, Chesterfield; Joseph W. Cudby, Dore; Peter R. Dixon, Wadsley, all of England

[73] Assignee: Injectall Limited, Sheffield, England

[21] Appl. No.: 158,290

[22] PCT Filed: Jul. 2, 1987

[86] PCT No.: PCT/GB87/00462

§ 371 Date: Feb. 15, 1988

§ 102(e) Date: Feb. 15, 1988

[87] PCT Pub. No.: WO88/00247

PCT Pub. Date: Jan. 14, 1988

[30] Foreign Application Priority Data

Jul. 5, 1986 [GB] United Kingdom ..... 8616455
Oct. 10, 1986 [GB] United Kingdom ..... 8624323

[51] Int. Cl.[4] ..... C21C 5/48

[52] U.S. Cl. ..... 266/270; 266/218; 266/271; 266/287

[58] Field of Search ..... 266/47, 218, 266, 267, 266/268, 269, 270, 271, 287, 226

[56] References Cited

U.S. PATENT DOCUMENTS

| | | | |
|---|---|---|---|
| 3,495,815 | 2/1970 | Holmes | 266/270 |
| 4,266,970 | 5/1981 | Iwaoka et al. | 75/59 |
| 4,298,192 | 11/1981 | Barbakadze et al. | 266/218 |
| 4,423,858 | 1/1984 | Ostlund | 266/270 |
| 4,494,735 | 1/1985 | Hershey | 266/218 |
| 4,575,393 | 3/1986 | Bates et al. | 75/53 |
| 4,742,995 | 5/1988 | Bates | 266/270 |

FOREIGN PATENT DOCUMENTS

| | | | |
|---|---|---|---|
| 0169290 | 1/1986 | European Pat. Off. . | |
| 3115108 | 10/1982 | Fed. Rep. of Germany . | |
| 2339 | 1/1953 | German Democratic Rep. . | |
| 289128 | 8/1969 | U.S.S.R. . | |
| 741030 | 10/1978 | U.S.S.R. . | |
| 796242 | 1/1981 | U.S.S.R. . | |
| 891786 | 12/1981 | U.S.S.R. | 266/270 |
| 808145 | 1/1959 | United Kingdom . | |
| 1083600 | 9/1967 | United Kingdom . | |
| 1170559 | 11/1969 | United Kingdom . | |
| 2094954 | 9/1982 | United Kingdom . | |
| 2140142 | 11/1984 | United Kingdom . | |
| 2171186 | 8/1986 | United Kingdom . | |

*Primary Examiner*—L. Dewayne Rutledge
*Assistant Examiner*—Robert L. McDowell
*Attorney, Agent, or Firm*—Buchanan Ingersoll; Alvin E. Ring

[57] ABSTRACT

An injection nozzle (10) is installed in the wall (13) of a liquid containment vessel (14) and comprises an assembly of refractory component bodies (18, 19, 20): injection passages (22) for receiving longitudinally movable lances (11) are provided in the nozzle and before injection commences, the passages are closed by cup-shaped refractory shells (30) embedded in one of the component bodies (18) adjacent a discharge end of the nozzle. Each shell has its base (31) united through a frangible shell portion (34) with the sidewall (32) and when injection is to commence, an associated lance (11) is forcibly driven at the base (31) to detach it by fracture of the shell portion (34) and from an opening through which an injectant can exit into the liquid. A push-out bung (26) may be incorporated in the nozzle body (18) between the base of the shell (30) and the discharge end of the nozzle (10).

25 Claims, 4 Drawing Sheets

NOZZLES FOR INJECTING SUBSTANCES INTO LIQUIDS

The present invention concerns improvements in nozzles for injecting substances into liquids.

More particularly, the injection nozzle is employed for injecting gases, gases plus powders, or solids—usually accompanied by gases, into potentially dangerous liquids, e.g. molten metals such as iron and steel. The purposes of injecting such substances are numerous and diverse. U.S. Pat. No. 4,575,393 outlines some of the reasons for introducing substances into molten metals and in this connection reference is directed to that publication for further details.

Like U.S. Pat. No. 4,575,393, the present invention is for use in injecting substances through a wall of a melt containment vessel such as a ladle. The wall could be the bottom or more usually the side of the vessel. Apparatus embodying the invention for example comprises a refractory nozzle block, pierced by an injection passage, for installing in the vessel wall, and which—before injection—is closed at its discharge or liquid confronting end to prevent melt entering the passage. A delivery pipe forming part of a lance assembly is movable in the passage, and means is provided to advance the pipe forcibly to the said end to dislodge and/or break a blocking element which is temporarily located at or in this end to close the passage. The pipe is thus used to open the passage for admitting a substance into the melt via the delivery pipe in this particular apparatus.

Not uncommonly, a containment vessel such as a ladle is filled with molten metal a considerable time before the metallurgist is ready to inject a substance, or substances, into it. We have found that with some of the less viscous melts especially, the melt is able to enter the injection passage despite the presence of the nozzle blocking element. One such melt is molten iron. The melt may enter the passage apparently having leaked along a joint between the blocking element and the refractory block or even having percolated through the blocking element itself. The consequences of the melt thus by-passing the blocking element are serious. First, the discharge pipe is normally located close behind the blocking element before injection is to be initiated. If, as sometimes happens, the melt enters the pipe it can freeze therein, closing the pipe. Injection may then be, and normally will be, impossible. Thus, an entire ladle of melt of perhaps more than 200 tonnes, may have to be left untreated when the metal will not realise its full commercial value. Second, while the presence of frozen melt behind the blocking element may not always prevent injection, it could interfere with the movement of the delivery pipe such that it cannot be advanced as far as it should be upon initiating injection. Safety devices with which the apparatus is furnished may then be unable to fulfil their designed functions. Such devices may be intended to secure the lance assembly e.g. against inadvertent removal or ejection by the pressure of the melt, and to manipulate the lance assembly to shut off the injection of substance(s) into the melt.

An object of this invention is to provide a nozzle block with a passage blocking element capable of effectively preventing melt from bypassing said element and entering the injection passage.

Another object is to provide a satisfactory blocking element, which can readily be broken and dislodged from the nozzle block, to open the injection passage for injection to commence.

According to the present invention, there is provided an injection nozzle for installing in the wall of a liquid containment vessel for use when injecting substances into a liquid, comprising a body having at least one injection passage extending towards a discharge end of the body and having a passage closing means imbedded therein, the passage closing means comprising a hollow shell closed at one end and resistant to percolation of the liquid therethrough, a sidewall and an end closing portion of the shell being united by a shell portion of reduced strength permitting a force applied to the closing portion to detach the latter from the sidewall for creating an opening between the passage and discharge end, for injection via the passage and opening thus created.

Also, according to the present invention there is provided a passage closing element for use in an injection nozzle to close an injection passage therein, comprising a fine grained refractory shell which is resistant to the percolation of liquids therethrough, the shell being hollow and closed at one end, a sidewall and end closing portion of the shell being united by a shell portion of reduced strength enabling the closing portion to be detached from the sidewall by breakage of the said shell portion.

The or each injection passage in the nozzle body may be lined for most of its length by an e.g. metal lining tube. For use with such a lining tube, the passage closing means can be a small tube-shaped, cup-shaped or thimble-shaped frangible shell, which is suitably located in the passage at or adjacent its discharge end.

The closing means and liner tube could, however, be combined into a single shell in the form of an elongated tubular element for lining all or a substantial part of the passage, the said element having one end closed in such a manner that this end, which is at or adjacent a discharge end of the nozzle body, can be broken away to open the injection passage by means of the lance pipe.

Accordingly, the percolation-resistant, elongated tubular element may have a portion of reduced strength adjacent the closed end to permit the closed end to be detached by a suitable force applied thereto from inside the tubular element. To permit detachment of the closed end, a juncture between the closed end and sidewall can comprise a shell portion of reduced thickness or strength.

The design of the above elongated tubular element could be reproduced in a tubular closing element which is significantly shorter than the nozzle body, and which is confined in the discharge end region of the nozzle body. Such an element can be used in conjunction with a suitable passage lining tube made of metal or ceramic.

The aforesaid tubular closing elements can be made of ceramic materials and could be produced easily from standard, readily-available refractory tubes used e.g. for temperature measuring probes such as thermocouples. The closed end area of such tubes is adapted by a simple machining operation to render the closed end detachable.

It is envisaged that tubular closing elements might be installed in nozzle blocks for replaceability, for the latter may enjoy a considerable service life. In contrast, tubular closing elements and indeed lance pipes will be consumable items normally useful for but one injection run.

The invention comprehends within its scope a combination of replacement components for installing in an injection nozzle, the said combination comprising a tubular ceramic element and a lance pipe slidable lengthwise in the tubular element, the latter being resistant to percolation of molten metal through its wall and having one end closed, and a portion of the tubular element contiguous with its closed end being of reduced strength to render the closed end detachable when struck by a blow delivered to the inside of the closed end of the lance pipe.

According to another aspect of the invention, a nozzle body is formed with a plurality of passages arranged at intervals along a ring, and at its discharge end the body has an annular closing member defining discharge portions of the passages which discharge portions are each closed by a frangible web, the said member including its webs being resistant to percolation of liquid into the passages, and the webs being detachable from the annular member by forces applied thereto from inside their associated passages.

The invention will now be described in more detail by way of example in connection with preferred embodiments thereof and by reference to the accompanying drawings. In the drawings, wherein like parts have the same numerals allotted thereto:

Figure 1:
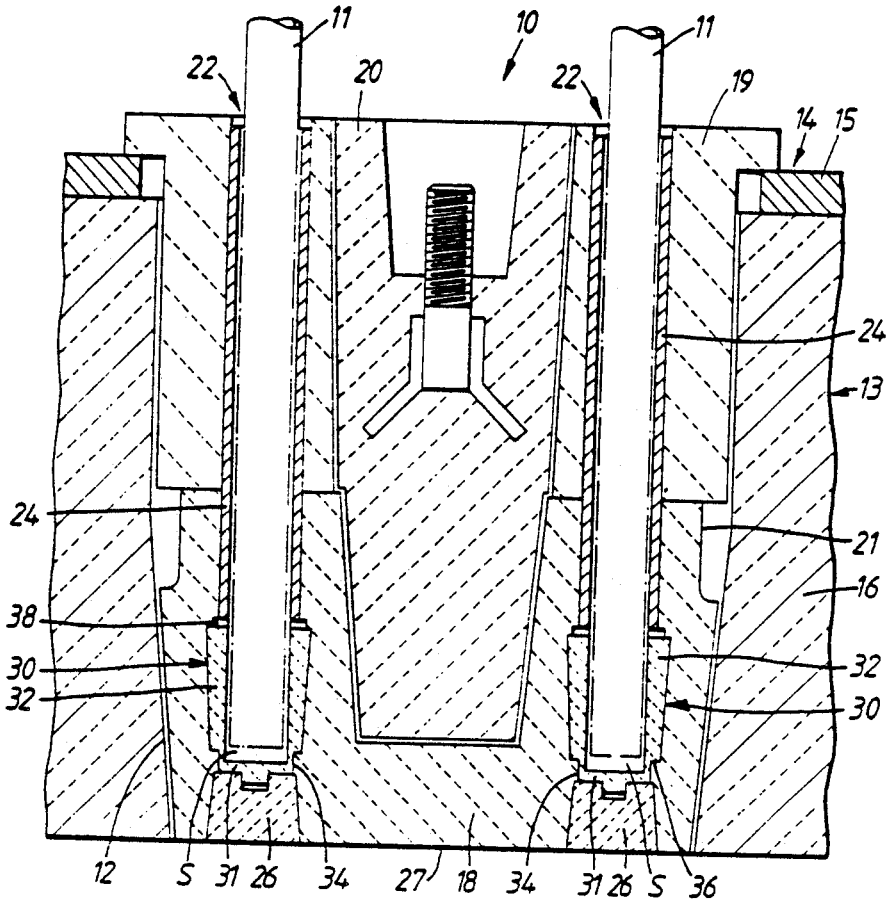
FIG. 1 is a cross-sectional view through a nozzle block embodying the invention and having a first nozzle blocking means.
Figure 4:
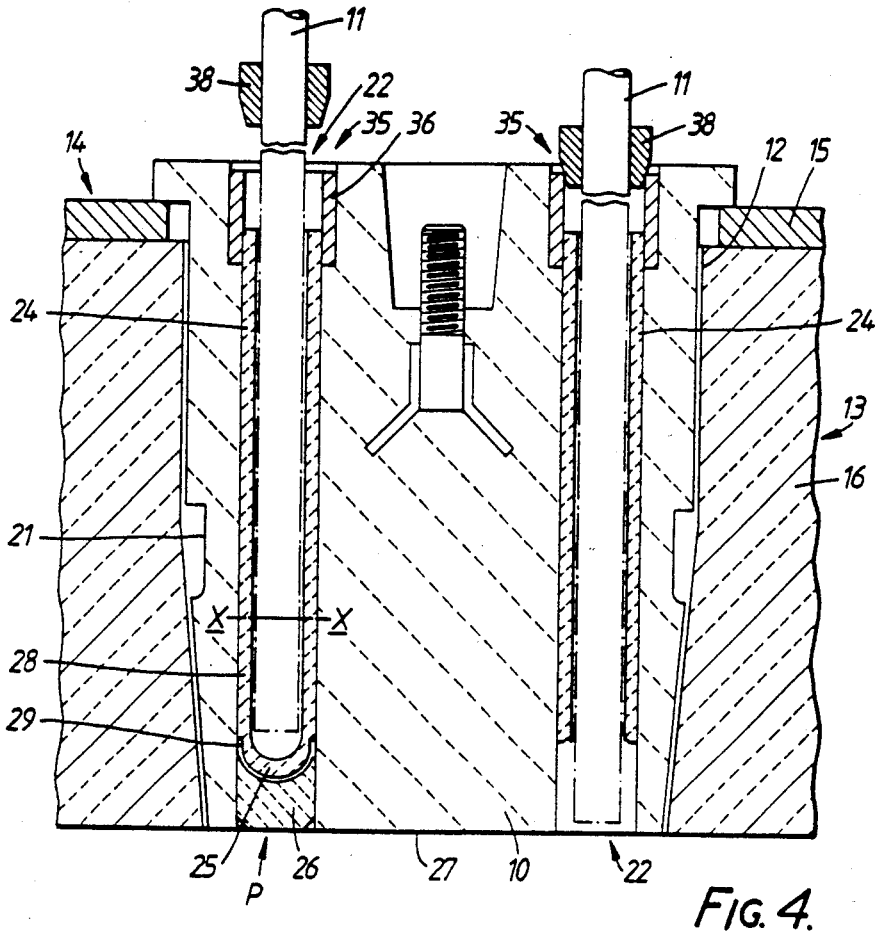
FIG. 4 is a cross-sectional view through another nozzle block embodying the invention.
Figure 6:
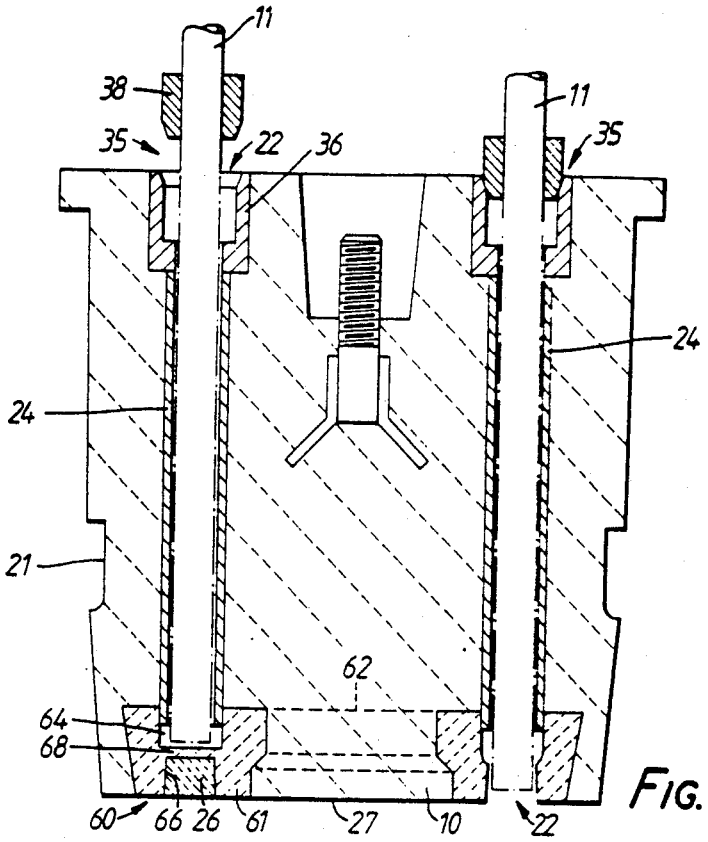
FIG. 6 is a cross-sectional view showing part of a third nozzle block embodying the invention.

What are shown in FIGS. 1, 4 and 6 are but parts of injection apparatus of the types disclosed more particularly in our patents and applications U.S. Pat. No. 4,575,393, Ser. No. 126,109, filed Oct. 13, 1987 and Ser. No. 158,274, filed Feb. 15, 1988, the disclosures of which are incorporated herein by reference. These patent and applications should be consulted for details of the mechanical components of the apparatus, their function and operation. The mechanical components are located outside a vessel to which the apparatus is mounted, i.e. to the top of the illustrations of FIGS. 1 and 4.

FIGS. 1 and 4 each show a plural passage, injection nozzle block 10 according to the invention and the delivery lance pipes 11 of an injection apparatus. By way of example, the nozzle block 10 canpossess four passages 22 each with a corresponding lance pipe 11, but more or fewer passages and lance pipes can be provided. We have designed eight and fifteen passage devices for injecting substances e.g. into molten iron. If desired, the nozzle block could be simplified to include only one passage and lance pipe. Such an arrangement is within the scope of this invention.

The nozzle block 10 is fitted in an opening 12 in a side or bottom wall 13 (usually the former) of a containment vessel such as a ladle 14. The location of the opening is such that substances can be injected at a substantial depth, e.g. 1 meter or more, below the surface of the liquid or melt. The ladle 14 is of conventional construction in having a steel shell 15 and insulating lining 16.

Block 10 is made of refractory material and may be an assembly of several component parts (FIG. 1) or a one-piece article (FIG. 4). The refractory material can be a suitable castable concrete. It may be preferred to assemble the block from several component parts to facilitate handling because the block can otherwise be of substantial weight depending on its size. Moreover, when made in several parts, refractories of different composition and properties can be chosen; for example a more melt and temperature resistant material can be employed for the component(s) that are contacted by the melt. As shown in FIG. 1, the block 10 is composed of an inner component 18, an outer component 19 and a central component 20. The inner component 18 is cemented into the opening 12 but components 19 and 20 are normally neither cemented to the former, nor to themselves, nor to the opening 12. Around its inner periphery, the inner component 18 has a recess 21. This provides a space to accommodate excess cement when this component is installed in the vessel wall 13. The appearance of a continuous fillet of cement around the recess 21 should indicate the joint between the inner component 18 and opening 12 will adequately guard against leakage. A one piece block 10 (FIG. 4) will be secured in opening 12 by cement applied around its inner end; it will be noted that a recess 21 for accommodating excess cement is shown in this Figure.

Together, components 18 and 19 of FIG. 1 define injection passages 22 in which the lance pipes 11 are longitudinally movable within liner tubes 24, e.g. of metal, which in part define the passages. Tubes 24 are cast in situ or cemented in the inner block component 18. The tubes 24 are not cemented to the outer block component 19.

The nozzle blocks 10 incorporate a passage closing element for each of their passages. Such elements can take several forms. The elements shown in FIGS. 1 to 3 will now be described.

In FIG. 1, the inner component 18 incorporates the passage closing elements for the passages 22. Each closing element has to prevent melt entering the associated passage 22 before injection commences, and is designed to be broken out from the inner block component by forcibly advancing the lance 11 to enable injection to commence. It is essential to ensure that melt cannot enter the space S between the lance end and the closing element. As shown in FIG. 1, each passage closing element is in two parts, and the inner component 18 is cast around them. The first part is a refractory bung 26 which, however, can be omitted as will be described later. Bung 26 tapers inwardly from the liquid contacting face 27 of the nozzle block, and its inner face interfits with the other part of the closing element by a spigot and socket formation, whereby the two parts are kept properly assembled while the inner component 18 is cast around them. Before casting the inner component, a parting compound may be applied to the bung 26 to ensure it can be ejected readily when the lance is advanced.

The other, and the essential part of the closing element is a hollow member 30 closed at one end and made of a dense, fine-grained refractory. In this embodiment, member 30 has the form of a cup or thimble and is referred to as such hereinafter. The thimble 30 has an end wall or base 31 which interfits with the bung 26 and a sidewall 32 the inside of which forms part of the passage 22. The metal liner tube 24 and thimble 30 for example have the same inside diameter. The base joins the sidewall by a transition wall segment 34 which is appreciably thinner than the rest of the sidewall 32. It will be seen, therefore, that the exterior of the thimble is stepped at 36 inwards towards its base. The transition wall segment 34 is right cylindrical in this example. It is of slightly smaller diameter than the smaller, inner end of the bung 26. Above the step 36, the sidewall 32 has a frusto-conical shape, enlarging away from the step.

Thanks to the stepped formation of the thimble 30, the base 31 can be detached from the sidewall 32 upon the lance 11 striking the inside of the base. The thin wall segment 34 breaks when the base is struck by the advancing lance and is pushed into the melt preceded by the bung 26, thus opening the passage 22 for injection to commence.

As stated, the thimble is dense and fine grained and should be made of a material through which the melt is unable to percolate. Melt may permeate along the join between the bung 26 and the block component 18 or even through the bung itself, but provided the thimble 30 is suitably made, it will not enter space S. Preferably the thimble 30 is made of multiple, but other refractory materials can be chosen. Often, it is impossible to ensure a refractory article is totally impenetrable and to avoid the possibility of penetration of the thimble, the latter can be set back sufficiently far from the face 27 that any melt that percolates inwardly into block 10 has become viscous or pasty on reaching the thimble. Inevitably, there is a falling temperature gradient away from the face 27. So long as any melt that penetrates around the bung 26 and base 31 is sufficiently hot as to be pasty, there should be no difficulty in breaking the base out of the thimble 30 and of dislodging it and the bung from the injection block.

It will be appreciated that when the vessel 14 is filled with e.g. molten metal, the nozzle block 10 becomes hot and liner 24 will expand. To avoid problems, a gasket e.g. of paper is placed between the end of the liner and the thimble 30 when casting the inner block component 18. In service, the paper may burn away leaving a space 38 allowing ample room for expansion of the liner 24.

Figure 2:
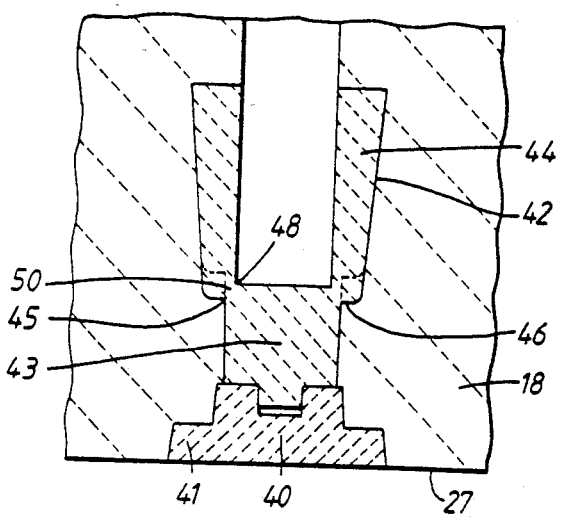
FIG. 2 is a fragmentary cross-sectional view of part of the block, showing a second nozzle blocking means.

FIG. 2 shows a second embodiment of the two part passage closing element. The two parts interfit as before. The outer part of the closing element is a bung 40 which has an enlarged head end 41 but otherwise is similar to bung 26. Thimble 42 differs from thimble 30 of FIG. 1 in having an appreciably thicker base portion 43.

The thimble is again stepped, but has no thin intermediate wall portion between its base 43 and sidewall 44. Instead, there is a relatively thin section between a corner 45 formed between the step 46 and the base 43, and a corner 48 where the inside wall of the thimble 42 meets the inside surface of the base 43. The base 43 breaks away at the section 50 from the sidewall when struck by the advancing lance, section 50 being weakened by the opposing corners 45, 48.

If desired, thimble 42 could be modified as shown by the dotted lines to possess a thin wall segment between the base 43 and sidewall 42.

Figure 3:
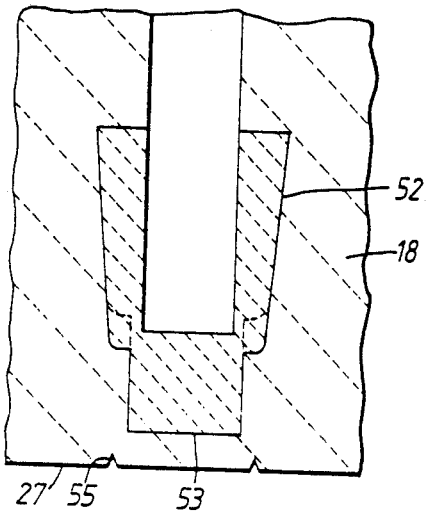
FIG. 3 is similar to FIG. 2 but shows a third nozzle blocking means.

Bungs 26 and 40 can take different forms, and are not essential as mentioned earlier. FIG. 3 shows an arrangement wherein only the thimble 52 is incorporated in the nozzle block. The thimble 52 shown is substantially the same as thimble 42, but thimble pattern 30 could be used. In each case, the base could omit the locating spigot. The thimble 52 is wholly embedded in the nozzle block component 18 and the end face 53 of its base is positioned close to the melt contacting face 27 of component 18. When the thimble base is struck by the advancing lance, it will break away and will break away that portion of the nozzle component 18 located between the thimble base and the melt. The said portion can be defined by a score line or indentation 55 which will assist the portion to break away cleanly.

When bungs 26 and 40 are employed, they could be weakly cemented into the block component 18.

Thimbles 42 and 52 will generally have bases that are parallel sided or tapered slightly towards their end faces. Conceivably they could be oppositely tapered, but this would complicate their manufacture. Thimbles 30 and 42, and bungs 26 and 40 respectively could be made integral one with the other, although this would complicate their manufacture.

When injection is completed and the vessel is emptied, the injection block is stripped down and replaced or refurbished. First, the outer and central components 19, 20 are removed (in the upward direction having regard to FIG. 1). The lance pipes 11 will generally be welded into the inner block component 18 by frozen melt. Hydraulically-operated pullers can be attached to the lance pipes for pulling them and inner component 18 from the opening 12 of the vessel. Should the lance pipes prove too weakly adhered to inner component 18 for this to be feasible, then a hole can be punched through the centre of the inner component and an expansible puller can be inserted through the hole for use in removing the inner component.

It will be recognised that only inner block component 18 will need frequent replacement. Components 19 and 20 can be reused repeatedly unless they are abused.

Figure 5:
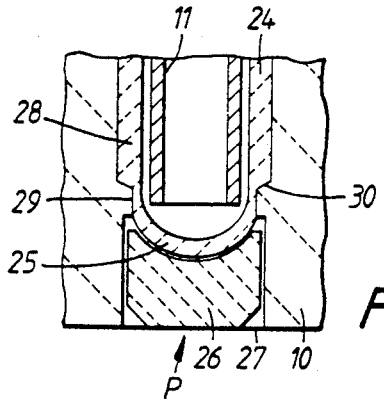
FIG. 5 is an enlarged vertical section view through the nozzle block of FIG. 4, from below the line X—X of FIG. 5.

Another embodiment is seen in FIGS. 4 and 5. Here, the passages 22 are lined by tubes 24 which slidably receive the lance pipes 11 for lengthwise movement of the latter. Each liner tube 24 is made of a refractory material impervious to the molten liquid and resistant to percolation of the liquid through its wall. It can be aluminous, e.g. mullite.

As well as lining the passages P, the tubes 24 serve as the passage closing means. For this purpose, each tube is closed at its end 25 located adjacent the discharge or melt-confronting end 27 of the nozzle block 10 to exclude melt before injection commences. The end is designed to be broken away from the remainder of the tube 24, by the lance pipe 11 to enable injection to commence.

As shown in FIG. 4, the liner tube 24 has its closed end set back from the discharge end 27 of the nozzle body 10. A refractory bung 26 as before is mounted in the body beside, and downstream of, tube end 25, but it could be omitted. The bung as shown in FIG. 4 has a different shape from the bungs shown in FIGS. 1 and 2 and its inner face interfits with the closed end of tube 24. The interfitting surfaces are e.g. part spherical.

Whilst the bung 26 and any cement holding it in place prevent or help prevent the molten liquid from contacting the refractory tube 24 before injection commences, the principal purpose of the bung 26 is to protect the tube 24 from thermal shock when the vessel or ladle 14 is first filled with the high temperature molten metal.

The juncture between the hemispherical closed end 25 and sidewall 28 comprises a tube portion 29 weaker than either the sidewall or the end wall. The weakening is achieved simply by making this portion 29 thinner than either the sidewall or the end wall. A step or shoulder 30 at the end of the sidewall and leading to the weakened portion 29 also has a weakening effect.

A hydraulic ram (not shown) forcibly advances the lance pipe and the weakened portion 29 shatters when the lance pipe impacts upon the inside of the closed end 25. Continued movement of the lance pipe thrusts the detached end 25 and bung 26 from the nozzle body into the molten metal. Gas, or gas plus treatment substance in powdered or solid form can then pass from the pipe 11 into the metal.

The step or shoulder 30 serves to anchor the refractory tube 24 in the block 10 when the closed end 25 is struck and detached. The tube 24 is larger than the seating in which the bung 26 is cemented. An anchoring of the cups or thimbles 30 of the earlier-described embodiments is similarly obtained.

The refractory tube 24 is simply and economically produced from readily available closed-ended thermocouple tubing. All that is necessary is to machine or grind away the refractory to form the weakened tube portion 29.

Necessarily, there is a clearance between the lance pipe 11 and the inside of the refractory tube. When the lance pipe 11 is advanced to initiate injection, molten metal from the vessel can run into the clearance gap. Because the tube 24 is a relatively good thermal insulator, the molten metal might fail to freeze before it reaches the outer end of the tube 24, and hence may escape. To guard against any danger there may be of the metal escaping by this route, the lance pipe 11 and tube 24 are provided with coacting sealing means 35. The sealing means comprise a seal sleeve 36 fitted about the outer end of the tube 24 and an interfitting collar 38 fitted to the lance pipe 11. Collar 38 may be metallic or could be a compressible material e.g. a compressible graphite-based substance. The metal sleeve and collar sealingly interfit when the lance pipe 11 has been moved to its advanced, injection position. In the probably unlikely event of molten metal running back as far as the sealing means 35, the latter will prevent its escape and indeed will probably chill the metal and cause it to freeze.

Such sealing means can be employed in any embodiment of this invention.

It will be recognised that the lance pipe 11 shown to the left in FIG. 4 is in the pre-injection position, the refractory tube 24 being closed and intact. To the right in FIG. 4, the lance pipe is in the advanced, injection position and the tube is shown open for injection (the closed end 25 and bung 26 having been ejected by the pipe 11).

Under normal operating conditions, the ladle 14 may contain molten metal for several hours before any injection runs are commenced. Refractory tubes 24 are well able to withstand prolonged exposure to the high temperatures of molten metals such as iron or steel. The lance pipes 11 may, however, be susceptible to degradation by oxidation at these temperatures. To guard against gradual oxidation of the lance pipes, which may be made of steel, they can be calorized. Alternatively, they can be composite metal and ceramic tubes though such may be more costly.

The embodiment of FIGS. 4 and 5 can be modified to be more cost effective by shortening the tube 24, whereby it serves as a liner for only a short segment of the passage 22. When so shortened, it is envisaged that the passage will be lined with a metal tube upstream of the modified tube 24. Modified tube 24 will be the end portion thereof, i.e. the portion below line X—X of FIG. 4. In essence then, the nozzle body will be as shown in FIG. 1 but with the thimble 30 replaced by the modified tube 24 comprising the said end portion thereof.

A still further embodiment is shown in FIG. 6 to which reference is now made.

In this embodiment, the nozzle body has an array of passages 22, e.g. fifteen, for a corresponding number of lance pipes 11. The passages are spaced apart along a ring of a chosen diameter. Sealing means comprising a cooperable collar 38 and sleeve 36 are provided and nozzle closing means 60 are fitted or embedded in the discharge end of the body. The closing means 60 comprises an annular refractory member 61 of fine grained, melt-resistant material through which the melt cannot percolate to any significant extent. The annular member 60 has lower and upper surfaces 61, 62, the latter being coplanar with the melt end face 27 of the body 10. Surface 62 could, however be set back from face 27 with the member 60 wholly embedded in the body 10. Coincident with the passages 22, there are recesses 64 in the upper surface 62. The passage lining tubes 24 extend into the recesses. Coincident with recesses 64 are recesses 66 in the lower surface 61, and plugs 26 are fitted in these recesses. The adjacent bottoms of the recesses 64 and 66 are spaced apart by a thin web 68 of the material forming the annular member. This web is relatively weak. It is weakened by adjacent corners of the two recesses. The arrangement is such that the webs 68 can be punched out when the lance pipes 11 are forcibly advanced, when the detached webs 68 and plugs 26 will be dispelled into the melt. To the left in FIG. 6, the lance pipe has yet to be advanced while to the right the pipe has been advanced for injection.

A modified form of annular member 60 could omit the recesses 66 and plugs 26, when the bottom surface 61 could be coplanar with the bottom face of the webs 68. Such an annular member may be inset within the body 10, with its lower face 61 covered by a relatively thin layer of body refractory. This layer could be scored or indented in coincidence with the webs 68 so as to define areas that are readily punched out when the lance pipes are advanced to sever the webs 68 from the annular member 60. In other words, the modified annular member 60 would be disposed in a manner closely similar to the arrangement shown in FIG. 3.

A full description of the injection operation is not given in this specification because the applications referred to earlier adequately disclose the operation.

The foregoing description and the drawings are illustrative only and various modifications will occur to the addressee which are within the scope of the invention claimed hereinafter.

Figure 7:
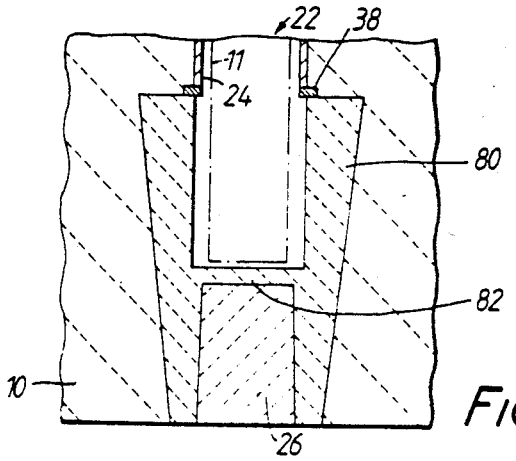
FIG. 7 is a partial cross-sectional view through another embodiment.

For example, reference to FIG. 6 shows that the closing means 60 has a generally "H" shaped vertical section at each passage location before injection is initiated, the horizontal cross-piece of the "H" section being the breakable web 68. Closing means in the form of shells individual to the passages (such as used in the arrangements described with reference to FIGS. 1 to 3) could be cylindrical bodies of revolution having generally "H" shaped vertical sections with passage-closing webs therein to be broken out by the lance pipe when injection is to be initiated. Such a closing means 80 is shown in FIG. 7 of the drawings installed in a nozzle body 10 at a discharge end of a passage 22 therein. Closing means 80 is a hollow shell, generally cylindrical, which is traversed by web 82 that can be detached from the remainder of the shell to open the passage 22 for injection.

In the foregoing specific description, the passages are opened for injection by forces exerted on the appropriate closing portions by blows from the forcibly-advanced lance pipes. The opening forces could be developed in other ways, however, for example by creating suitable gas pressures in the passages against the closing portions.

We claim:

1. An injection nozzle for the wall of a liquid containment vessel for use when injecting substances into the liquid, comprising a body having at least one injection passage extending to a discharge end of the body, a passage closing means embedded in the body, the closing means comprising a hollow shell closed at one end and resistant to percolation of liquid therethrough, a sidewall and end closing portion of the shell being united by a shell portion of reduced strength permitting a force applied to the closing portion to detach the latter from the sidewall and create an opening between the passage and the discharge end, for injection via the passage and said opening.

2. A nozzle according to claim 1, wherein the shell has its end closing portion directed toward the discharge end of the body, and its sidewall at least in part defines the passage.

3. A nozzle according to claim 1, wherein the shell has its end closing portion directed toward the said discharge end and separated therefrom by a portion of the body which is separable from the remainder of the body when the end closing portion is detached from the sidewall of the shell.

4. A nozzle according to claim 1, wherein the shell has its end closing portion directed toward the said discharge end and separated therefrom by a bung embedded in the discharge end of the body, the bung and end closing means being dislodgeable from the body when the end closing means is detached from the sidewall of the shell.

5. A nozzle according to claim 1, wherein the shell is a cup or thimble shaped element.

6. A nozzle according to claim 5, wherein the shell defines a portion of the passage adjacent the said discharge end, and a separate passage-lining tube extends upstream from the shell through the body.

7. A nozzle according to claim 1, wherein the shell is a tubular element having an integral closed end, and its sidewall thickness is reduced adjacent the said end locally to weaken said shell and render the closed end detachable in response to the said force.

8. A nozzle according to claim 7, wherein the shell defines a portion of the passage adjacent the said discharge end, and a separate passage-lining tube extends upstream from the shell through the body.

9. A nozzle according to claim 7, wherein the tubular shell is located adjacent the said discharge end, and extends through a major part of the body to serve as a passage-defining liner means.

10. A nozzle according to claim 1, wherein the shell is stepped inwardly from its sidewall to its end closing portion and has confronting outer and inner corners which define the weakened shell portion and make it frangible therebetween, thereby rendering the closing portion detachable.

11. A nozzle according to claim 1, wherein the shell is stepped inwardly between its sidewall and end closing portion to form a thin intervening shell portion which is frangible to render the base detachable.

12. A nozzle according to claim 1, wherein the shell has its end closing portion directed toward the said discharge end and its sidewall has an external surface which enlarges away from the said end closing portion.

13. A nozzle according to claim 1, in combination with a slidingly movable lance pipe in said at least one passage of the nozzle body.

14. Injection apparatus comprising a nozzle according to claim 1, a lance pipe slidingly movable in said at least one passage, means for forcibly advancing the pipe lengthwise in the passage from a standby position to an injection position, for causing the pipe to impact upon the closing means and sever the detachable portion therefrom during the advancing movement, and means to connect the lance pipe to a source of pressurized gas or gas plus other treatment substance to be injected.

15. An injection nozzle for installing in the wall of a liquid containment vessel, for use when injecting substances into the liquid, comprising a nozzle body formed with a plurality of passages arranged at intervals along a ring, and at its discharge end the body has an annular closing member defining discharge portions of the passages which discharge portions are each closed by a frangible web, the said member including its webs being resistant to percolation of liquid into the passages, and the webs being detachable from the annular member by forces applied thereto from inside their associated passages.

16. A nozzle according to claim 15, wherein the closing member has recesses coincident with the passages in one surface thereof, bottoms of the recesses being formed by the frangible webs.

17. A nozzle according to claim 16, wherein the closing member is inset from a discharge face of the body and is enclosed within the material forming said body, portions of the body covering the frangible webs being adapted to be detachable from the remainder of the body with the webs, when the latter are detached by the said forces.

18. A nozzle according to claim 15, wherein the closing member has first recesses coincident with the passages in a first surface of the said member and second recesses coincident with the first recesses in a second surface of the said member, the frangible webs being disposed between the bottoms of respective recesses, and dislodgeable plugs being seated in the second recesses.

19. A nozzle according to claim 15, in combination with slidingly movable lance pipes in passages of the nozzle body.

20. Injection apparatus comprising a nozzle according to claim 15, lance pipes slidingly movable in passages of the body, means for forcibly advancing a pipe lengthwise in its passage from a standby position to an injection position, for causing the pipe to impact upon the closing means and sever the detachable portion therefrom during the advancing movement, and means to connect a lance pipe to a source of pressurized gas or gas plus other treatment substance to be injected.

21. A combination of replacement components for installing in an injection nozzle, comprising a metal lance pipe, a tubular guide element for slidably receiving the said pipe, and a refractory closing element resistant to percolation of liquids therethrough, the closing element being of reduced strength adjacent a closing portion thereof to render the latter readily detachable from the remainder of said element when the closing portion is struck.

22. A passage closing element for use in an injection nozzle to close an injection passage therein comprising a hollow, fine-grained refractory shell which is closed at one end and is resistant to the percolation of liquids therethrough, the shell having an end closing portion and sidewall united by a shell portion of reduced strength enabling the end closing portion to be detached from the sidewall by breakage of the said shell portion.

23. A passage closing element for use in an injection nozzle to close injection passages therein, comprising an annular, fine-grained refractory body resistant to the percolation of liquids therethrough, the annular body having recesses in a surface thereof to define apertures for discharge of injectants, the recesses extending to and terminating in thin closing webs and the body being of weakened configuration adjacent the webs to enable them to be broken away from the remainder of the body.

24. An injection nozzle for the wall of a liquid containment vessel, for use when injecting substances into the liquid, comprising a nozzle body having at least one injection passage and a passage closing means initially closing said passage, said closing means comprising a fine-grained refractory shell which is resistant to percolation of liquid therethrough, said shell being a generally cylindrical hollow body having a transverse passage-closing web, said shell being of generally "H"-shaped cross-section, and said web being detachable from the shell, in use to create an opening therethrough enabling injection from said passage to commence.

25. A passage closing element for use in an injection nozzle to close an injection passage therein, comprising a fine-grained refractory shell which is resistant to percolation of liquid therethrough, said shell being a hollow body having a transverse web and having a generally "H"-shaped cross-section, said web being detachable from said shell by breaking away from the remainder of said shell.

* * * * *

UNITED STATES PATENT AND TRADEMARK OFFICE

CERTIFICATE OF CORRECTION

PATENT NO. : 4,789,141

DATED : December 6, 1988

INVENTOR(S) : KENNETH W. BATES, JOSEPH W. CUDBY, PETER R. DIXON

It is certified that error appears in the above-identified patent and that said Letters Patent is hereby corrected as shown below:

Column 3, line 58, change "canpossess" to --can possess--.

Column 5, line 26, change "multiple" to --mullite--.

Signed and Sealed this

Eleventh Day of April, 1989

*Attest:*

DONALD J. QUIGG

*Attesting Officer*

*Commissioner of Patents and Trademarks*